US006247534B1

(12) United States Patent
Newman

(10) Patent No.: US 6,247,534 B1
(45) Date of Patent: Jun. 19, 2001

(54) WELLBORE CABLE SYSTEM

(75) Inventor: Kenneth R. Newman, Willis, TX (US)

(73) Assignee: CTES, L.C., Conroe, TX (US)

( * ) Notice: Subject to any disclaimer, the term of this patent is extended or adjusted under 35 U.S.C. 154(b) by 0 days.

(21) Appl. No.: 09/345,908

(22) Filed: Jul. 1, 1999

(51) Int. Cl.[7] ..... E21B 23/14
(52) U.S. Cl. ..... 166/77.1; 166/385
(58) Field of Search ..... 166/84.4, 77.1, 166/77.2, 384, 77.3, 84.1, 385

(56) References Cited

U.S. PATENT DOCUMENTS

| | | |
|---|---|---|
| 2,008,612 | 7/1935 | Heath . |
| 2,630,180 | 3/1953 | Summers . |
| 2,677,427 | 5/1954 | McKinney et al. . |
| 2,720,266 | 10/1955 | Broussard et al. . |
| 2,816,439 | 10/1957 | McCullough et al. . |
| 3,182,877 | 5/1965 | Slator et al. . |
| 3,866,679 | 2/1975 | Laky . |
| 3,920,076 | 11/1975 | Laky . |
| 4,071,086 | 1/1978 | Bennett . |
| 4,091,867 | 5/1978 | Shannon, Jr. et al. . |
| 4,456,225 | 6/1984 | Lucas . |
| 4,515,211 | 5/1985 | Reed et al. . |
| 4,529,148 | 7/1985 | Hesprich et al. . |
| 4,585,061 | 4/1986 | Lyons, Jr. et al. . |
| 4,655,291 | 4/1987 | Cox . |
| 4,850,569 | 7/1989 | Griffioen et al. . |
| 5,011,333 | 4/1991 | Lanan . |
| 5,188,173 | 2/1993 | Richardson et al. . |
| 5,211,377 | 5/1993 | Griffioen et al. . |
| 5,311,952 | 5/1994 | Eddison et al. . |
| 5,324,006 | 6/1994 | Pickrell . |
| 5,411,085 | 5/1995 | Moore et al. . |
| 5,503,370 | 4/1996 | Newman et al. . |
| 5,553,668 | 9/1996 | Council et al. . |
| 5,599,004 | 2/1997 | Newman et al. . |
| 5,738,173 | 4/1998 | Burge et al. . |
| 5,823,267 | 10/1998 | Burge et al. . |
| 5,833,004 | 11/1998 | Coronado . |
| 5,839,514 | 11/1998 | Gipson . |
| 5,842,530 | 12/1998 | Smith et al. . |
| 5,845,708 | 12/1998 | Burge et al. . |
| 5,845,711 | 12/1998 | Connell et al. . |
| 5,848,642 | 12/1998 | Sola . |
| 6,116,578 * | 9/2000 | Pruett ..... 254/134.4 |

OTHER PUBLICATIONS

Development Of A Coiled Tubing Cable Installation System, Newman et al, SPE 30679, Oct. 1995.

CTD Poised To Make An Impact On Segments Of A Drilling Market, The American Oil & Gas Reporter, pp. 104, 106–108, Apr. 1996.

Installation of 2 7/8 in. Coiled Tubing Tailpipes In Line Gas Wells, Campbell et al, JPT, May 1994.

* cited by examiner

*Primary Examiner*—Frank S. Tsay
(74) *Attorney, Agent, or Firm*—Guy McClung

(57) ABSTRACT

The present invention, in certain embodiments, discloses a method for moving a conduit, e.g. a cable, in certain wellbore operations, the method, in certain aspects, including a method for introducing cable into a wellbore, the method including providing wellbore cable through a pressure control device to a capstan drive system above an earth wellbore, and pulling the wellbore cable through the pressure control device with the capstan drive system.

11 Claims, 2 Drawing Sheets

WELLBORE CABLE SYSTEM

BACKGROUND OF THE INVENTION

1. Field of the Invention

This invention relates to systems and methods for introducing cable and items connected thereto into a wellbore and, in certain particular aspects to a system with a capstan drive apparatus for facilitating the introduction of cable into a wellbore reducing or eliminating the need for added weight, e.g. sinker bars.

2. Description of Related Art

Various operations in a wellbore require the raising and lowering of various tools and equipment on a cable within the wellbore. For example, in wellbore logging operations a logging system is hung from a cable and moved into and out of the wellbore by raising and lowering the cable. In various prior art wellbore cable systems, the tools or equipment for introduction into and movement within a wellbore are connected to one end of the cable and the other end is connected to some type of winch or other raising/lowering system. In many systems, the cable is passed over one or more sheave wheels positioned between the winch and the wellbore. It is common for one such sheave wheel to be secured to a derrick or rig above the wellbore as well as one such sheave wheel mounted below on the ground or on a rig platform. Such systems typically employ a fluid pressure control system to counterbalance the pressure of fluid in the well which can oppose the introduction into the wellbore of the cable and items connected thereto. Often weight (e.g. sinker bars) is added to the items hung from the cable to counter upward fluid pressure in the wellbore and to pull the cable through the fluid pressure control system. This added weight requires a corresponding increase in height of a lubricator used above the wellhead between it and the sheave wheel(s). The lubricator is long enough to hold all of the tools going downhole, including the sinker bars.

In the prior art systems described above the height of an entire system above the rig platform can be substantial, e.g. forty-five or more feet. The problems associated with such high systems were addressed in U.S. Pat. No. 5,188,173 which discloses a cable system for use in well cable operations in association with a rig at the surface, the system having a pressure control device for counterbalancing the fluid pressure from the well; a high pressure chamber through which the cable passes; and a cable sheave wheel incorporating the chamber. By using the cable sheave wheel in its own pressurized chamber and pointing the chamber downward, an effort is made to reduce overall system height. The sheave wheel of the systems of U.S. Pat. No. 5,188,173 has a groove for receiving and holding the cable.

There has long been a need for an effective and efficient system for introducing cable into a wellbore whose overall height is reduced as compared to the height of prior art systems and which adequately moves the cable into the wellbore. There has long been a need for a system which pulls the cable through a pressure control device in high pressure wells and thus reduces or eliminates the need for sinker bars thereby reducing rig up height.

SUMMARY OF THE PRESENT INVENTION

The present invention, in certain aspects, provides a method and system for introducing cable and items connected thereto into a wellbore. In certain embodiments the system has a powered drive system with a rotatable capstan ring about which the cable is wrapped several times. The capstan drive system is positioned between a pressure control device or stuffing box (on one side and a lubricator system on the other) on one side and the wellbore on the other. The lubricator system is attached to a wellhead over the wellbore. The capstan drive system pulls the cable through the pressure control device. A motor rotates the capstan ring via appropriate gearing.

The pulling force generated by the capstan pulls the cable through the pressure control device overcoming the wellhead pressure times cable area force (wellhead pressure force) that seeks to blow the cable out of the pressure control device. In previous systems this wellhead pressure force was overcome by adding sinker bars (weights) to the tool. With systems according to the present invention, the need for the sinker bars is reduced or eliminated, reducing the length of lubricator needed, and thus reducing the height of the system.

In certain aspects the capstan's rotatable ring has a flat outer surface with no groove or grooves, unlike the sheave of many prior art systems (e.g. that of U.S. Pat. No. 5,188,173) which has one or more grooves. The flat capstan surface allows the cable to be wrapped around the capstan a plurality of times, and to slide across the face of the capstan ring, as it progresses through the plurality of wraps. Such a capstan is a tension multiplier. The amount that the capstan multiplies the tension is given by the following equation:

$$\frac{T_2}{T_1} = e^{2\mu\pi n}$$

where:

$T_1$ is the initial tension caused by the weight of the logging tools $T_2$ is the final tension—the tension in the cable being pulled through the stuffing box $\mu$ is the friction coefficient—usually about 0.18 for an oil wet environment $\pi$ is 3.14159 n is the number of wraps the cable makes around the capstan

For example, assuming a friction coefficient of 0.18 and the number of wraps as 4.5, the tension multiplication factor ($T_2/T_1$) is 162.3. Thus if the weight of the logging tools is 100 lbs, the driven capstan multiplies this tension to 16,230 lbs. Thus as much as 16,230 lbs of tension would be available to pull the cable through the pressure control device. The stator or scroll in the housing serves to guide the cable across the capstan face so that the cable does not cross over itself or become tangled in some way.

One of the critical parameters which is measured during a wireline operation is the hanging weight of the cable and tools in the well, typically referred to simply as "weight". This weight measurement is typically measured with a load cell located either at the wireline reel or at a sheave at the base of the wellhead. The capstan in this invention will be changing the tension in the cable, so it will be difficult to measure the weight in these locations. Thus a small sheave wheel or roller is mounted on a load measuring device and located on the wellbore side of the capstan. A load is generated at this small sheave or roller by having the cable change its angle slightly around this sheave or roller. This change in angle causes a load in the sheave or roller which is proportional to the weight.

What follows are some of, but not all, the objects of at least certain preferred embodiments of this invention. In addition to the specific objects stated, other objects and purposes will be readily apparent to one of skill in this art who has the benefit of this invention's teachings and disclosures. It is, therefore, an object of at least certain preferred embodiments of the present invention to provide:

- New, useful, unique, efficient, non-obvious systems and methods for introducing cable and items connected thereto into a bore or well;
- Such systems and methods which employ a capstan drive;
- Such systems which result in a significant reduction in rig-up height;
- Such systems and method which employ a driven capstan without grooves about which the cable is wrapped; and
- Such systems with a stator or scroll to guide the cable across the capstan.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
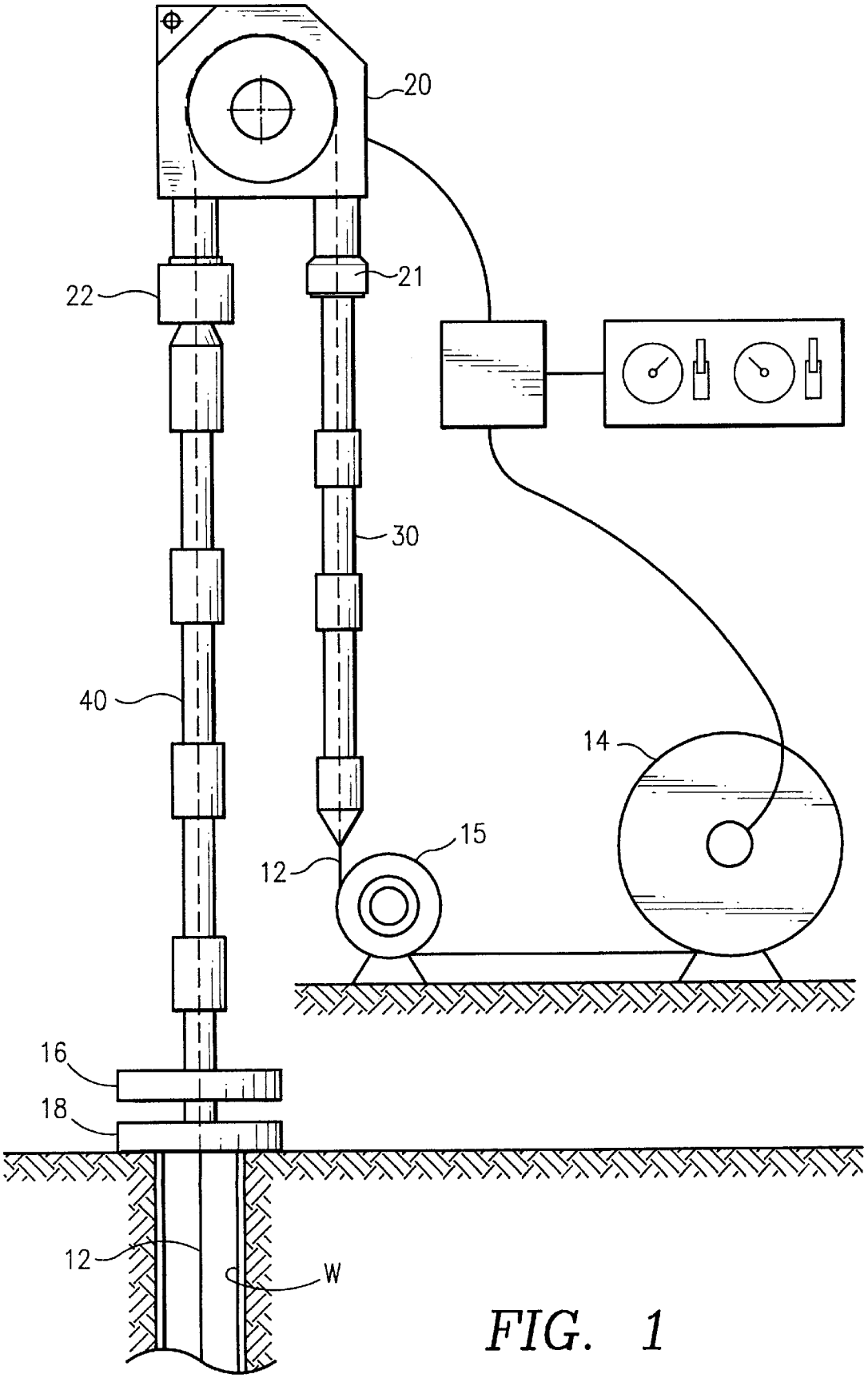
FIG. 1 is a schematic view of a system according to the present invention.

Referring now to FIG. 1 a system 10 according to the present invention (shown schematically) has a capstan drive system 20 which receives a conduit in through a connection 21 and drives it out through a connection 22. The conduit may be any cable, wire rope, tube; mechanical, electrical and/or hydraulic; slickline, braided cable, wire rope electrical conductor(s), logging cable; and/or any combination thereof—referred to in what follows as a "cable" 12. The cable 12 is fed from a reel 14, around a sheave or roller 15, upward through a pressure control device or stuffing box 30, and through the connection 21 between the pressure control device 30 and the capstan drive system 20. The cable passes several times around a driven capstan ring 42 and then passes downward through a lubricator 40, through a pressure control equipment 16, and through a wellhead 18 into the well W. In one aspect, the reel 14 is power driven and controlled, e.g. with a motor 17 and acts like a powered winch.

Figure 2:
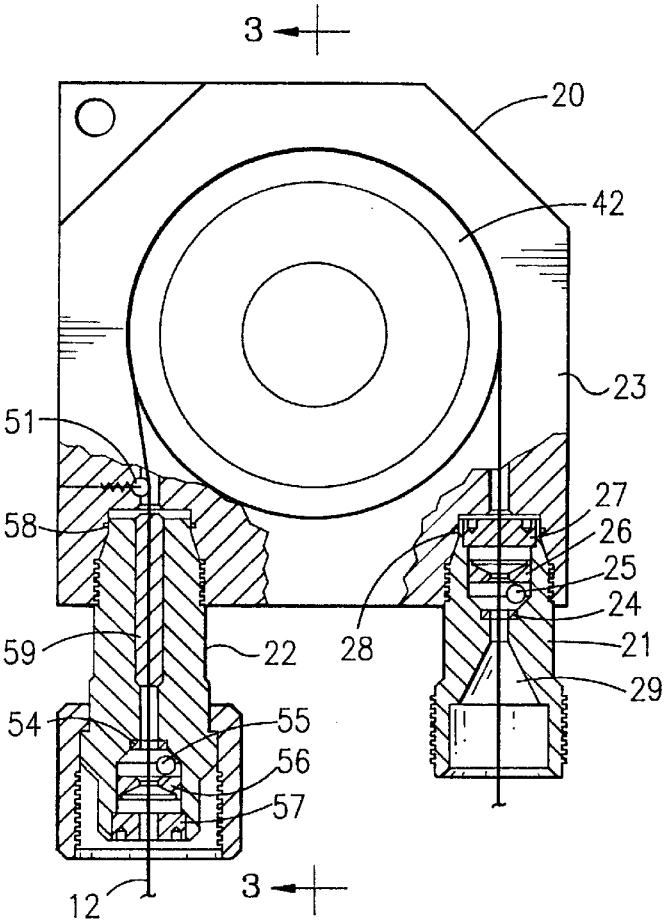
FIG. 2 is an enlarged view, partially cut away, of part of the system of FIG. 1
Figure 3:
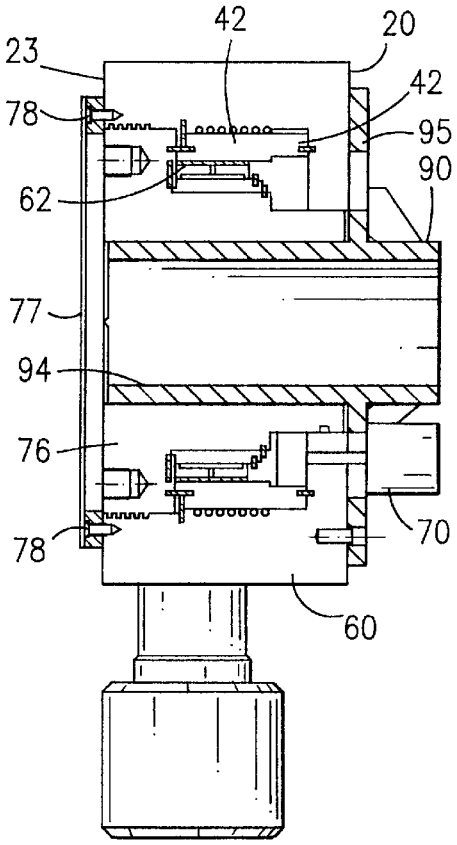
FIG. 3 is a view along line 3—3 of FIG. 2. (add line 3—3 to FIG. 2).
Figure 4:
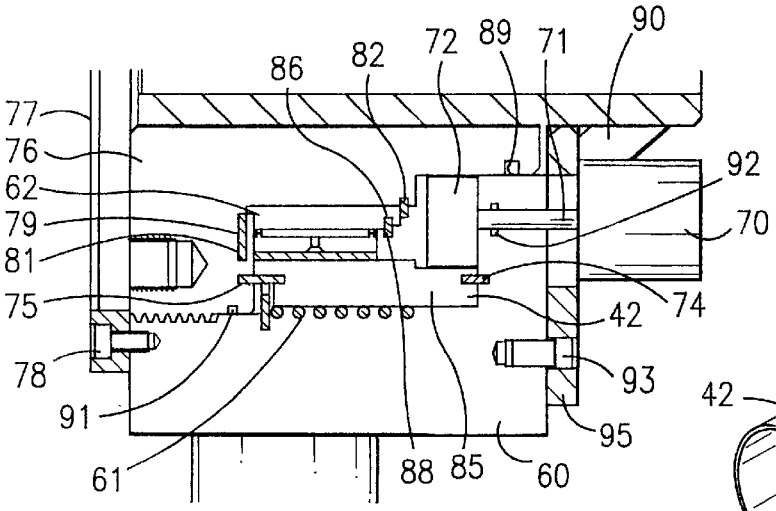
FIG. 4 is an enlargement of part of FIG. 3.
Figure 5:
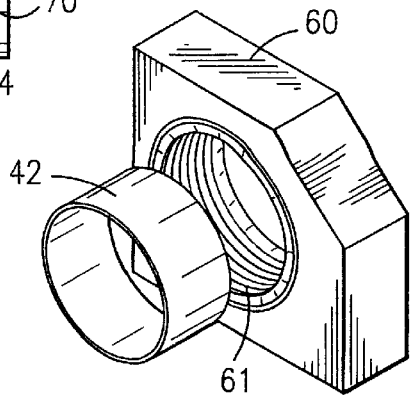
FIG. 5 is a perspective view of a rotatable ring and housing of the system of FIG. 1 showing stator grooves of the housing.

As shown in FIGS. 2–4 the capstan drive system 20 has a housing 23 within which is rotatably mounted a ring 42 around which the cable 12 is wrapped one or more times, preferably at least once or several wraps.

The connection 21 has a central cable channel 29 therethrough from top to bottom and its upper end is threadedly secured to the housing 23. The connector 21 has a valve seat 24 and a ball 25 which seats against the seat 24 to act as a check valve when no cable is present. A bushing 26 centralizes the cable and a wiper 27 wipes wellbore fluid from the cable. An O-ring 28 seals the housing/connector interface. The connector 22 has a cable guide 59 and a top threadedly secured to the housing 23. An O-ring 58 seals the housing/connector interface. A ball 55 seats against a seat 54 to act as a check valve when no cable is present. A bushing 56 centralizes the cable and a wiper 57 wipes wellbore fluid from the cable. The check valves prevent wellbore fluids from escaping if the cable is withdrawn from the system. A weight sensor 51 is disposed in the housing 23 above the connector 13 in contact with the cable 12 for sensing the weight of the cable 12 and items attached thereto in the wellbore W. The weight sensor produces either an electronic or hydraulic signal indicative of this weight and transmits it to a control panel display.

As shown in FIGS. 3 and 4, the rotatable ring 42 has a flat outer 30 surface about which the cable 12 is wrapped. The ring 42 is rotated within a pressure housing 60 that includes a stator (or scroll) that comprises a thread-like groove 61 which guides the cable 12 across the exterior surface of the ring 42. The ring 42 is disposed about a roller bearing 62 that facilitates ring rotation. The cable wraps fit into the stator groove 61 as they move across the ring 42.

A shaft 71 of a motor 70 passes through a seal 92 and is connected to a gear 72 whose teeth mesh with corresponding teeth on an inner diameter of the ring 42 to rotate the ring. The shaft seal 92 seals the shaft/stator interface. Power is supplied to the motor 70 from any suitable known power source (not shown). A protector member 74 disposed in a corresponding recess in the housing 60 and a protector member 75 disposed in corresponding recesses in the ring 42 and an inner housing ring 76 inhibit the passage of grease, wellbore fluids etc. from the ring/stator interface to the roller bearing 62 and other apparatus. A locking ring 77 locks the inner housing ring 76 to the housing 60 with bolts 78. Seals 89 and 91 seal the inner housing ring/housing interface.

A thrust bearing 79 co-acts with the roller bearing 62 to facilitate movement of ring 42. Snap rings 82 and 86 hold a non-rotating roller bearing inner race in position. Parts of the snap rings project into a space 85.

Bolts 93 through a flange 95 secure a weldment member 90 to the housing 60. The stator groove 61 is disposed around a central portion 94 of the central body 90. In certain embodiments the stator groove 61 is optional.

In one embodiment, a system 20 is operated by an operator at a control panel 100 for controlling the reel 14 and the system 20. A power source 103 provides power for the reel and the system 20. Appropriate lines and conduits are interconnected between the panel 100, the reel 14, the power source 103 and the system 20. To run a conduit or cable into the well W, the operator sets the reel 14 so it is ready to allow cable to enter the well W with an amount of back tension held by the reel. The operator then operates the control panel 100's controls to control the motor 70 and rotate the ring 42 in an in-hole direction. The ring 42 thus pulls cable from the reel 14, through the stuffing box 30, and allows it to go into the well W. The operator controls the speed of cable entering the well (and coming out) by controlling the speed of the ring 42. TO remove cable from the well W, the operator sets the reel to pull cable from the well W onto the reel 14, preferably at a low tension level. The ring 42 is rotated in an out-hole direction. The weight sensor 51 is interconnected with the control panel 100 and continuously provides the operator with a weight reading.

The present invention, therefore, provides in certain, but not necessarily all embodiments, a method for introducing cable into a wellbore, the method including providing wellbore cable through a pressure control device to a capstan drive system above an earth wellbore, and pulling the wellbore cable through the pressure control device with the capstan drive system. "Cable" includes any conduit disclosed herein. Such a method may also include one, some (in any possible combination) or all of the following: wherein the capstan drive system includes a ring driven by a motor, the cable wrapped at least once around the ring, the method including rotating the ring with the motor to pull the cable through the pressure control device; wherein the ring has a flat outer surface and the cable is wrapped on said flat outer surface; wherein a stator apparatus (e.g., but not limited to a thread or grooves on the housing) is provided with an inner surface near the ring, the method including guiding the cable with respect to the ring with the stator apparatus; wherein the cable is wrapped a plurality of times around the ring and the stator apparatus comprises an open thread-like groove, the method including the stator guiding portions of the cable across the ring; wherein the pressure control device is a stuffing box; wherein lubricator apparatus is disposed between the capstan drive system and a wellhead on the wellbore, the cable movable through the lubricator and wellhead and into the wellbore, the method including lubricating the cable passing through the lubricator apparatus; wherein a lower end of the cable has at least one wellbore tool connected thereto, the method including introducing the at least one wellbore tool down into the wellbore; wherein the at least one wellbore tool is a wellbore logging system.

The present invention, therefore, provides in certain, but not necessarily all embodiments, a capstan drive system for pulling a cable through a wellbore pressure control device, the capstan drive system including a motor, a ring rotatable by the motor to pull a cable through a pressure control device, the ring having a flat outer surface, the cable wrapped on said flat outer surface, and stator apparatus adjacent the ring for facilitating positioning of the cable with respect to the ring; and such a system with a thread-like groove in a surface of the stator apparatus for receiving portions of the cable to facilitate positioning of the cable with respect to the ring. "Cable" includes any conduit disclosed herein.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims are in accordance with all of the requirements of 35 U.S.C. § 112. The inventors may rely on the Doctrine of Equivalents to determine the scope of the claims that follow.

What is claimed is:

1. A method for introducing cable into a wellbore, the cable being flexible and solid and having a substantially constant diameter along its length, the method comprising providing the cable through a pressure control device to a capstan drive system above an earth wellbore, and pulling the cable through the pressure control device with the capstan drive system, the capstan drive system including a housing and a ring within the housing, the ring driven by a motor, the cable wrapped at least once around the ring, the ring having a flat outer surface without edge flanges and the cable wrapped on said flat outer surface, the method further comprising rotating the ring with the motor to pull the cable through the pressure control device, and wherein a scroll apparatus is provided on the housing of the capstan drive system, the scroll apparatus comprising a thread-like groove on an inner surface of the housing, the thread-like groove adjacent the ring, the scroll apparatus in continuous contact with the cable and the cable fitting into the thread-like grove as the cable moves across the ring, the method further comprising continuously guiding the cable across the ring's flat outer surface with the scroll apparatus.

2. The method of claim 1 wherein the pressure control device is a stuffing box.

3. The method of claim 1 wherein lubricator apparatus is disposed between the capstan drive system and a wellhead on the wellbore, the cable movable through the lubricator and wellhead and into the wellbore, the method further comprising lubricating the cable passing through the lubricator apparatus.

4. The method of claim 1 wherein a lower end of the cable has at least one wellbore tool connected thereto, the method further comprising introducing the at least one wellbore tool down into the wellbore.

5. The method of claim 4 wherein the at least one wellbore tool is a wellbore logging system.

6. The method of claim 1 further comprising logging the wellbore with the wellbore logging system.

7. The method of claim 1 wherein the cable is selected from the group consisting of mechanical cable and electrical cable.

8. The method of claim 1 wherein the cable is selected from the group consisting of slickline, wire rope, braided cable, and logging cable.

9. A capstan drive system for pulling a cable through a wellbore pressure control device, the cable being flexible and solid and having a substantially constant diameter along its length, the capstan drive system comprising a motor, a housing, the housing having an inner surface, a ring in the housing, the ring rotatable by the motor to pull a cable through a pressure control device, the ring having a flat outer surface, the cable wrapped on said flat outer surface, and a scroll apparatus on the housing of the capstan drive system, the scroll apparatus comprising a thread-like groove on the inner surface of the housing, the thread-like groove adjacent the ring, the scroll apparatus in continuous contact with the cable and the cable fitting into the thread-like groove as the cable moves across the ring.

10. The capstan drive system of claim 9 wherein the cable is selected from the group consisting of mechanical cable and electrical cable.

11. The capstan drive system of claim 9 wherein the cable is selected from the group consisting of slickline, wire rope, braided cable, and logging cable.

* * * * *